United States Patent [19]

Olander

[11] 4,344,230

[45] Aug. 17, 1982

[54] LEATHER TOOLING APPARATUS

[76] Inventor: Donald A. Olander, 3555 E. County Rd. 14, Loveland, Colo. 80537

[21] Appl. No.: 297,019

[22] Filed: Aug. 27, 1981

Related U.S. Application Data

[63] Continuation of Ser. No. 941,868, Sep. 13, 1978, abandoned.

[51] Int. Cl.[3] ..... B26B 7/00

[52] U.S. Cl. ..... 30/272 R; 30/164.9; 30/317

[58] Field of Search ..... 30/272 R, 272 A, 317, 30/164.9, 164.95

[56] References Cited

U.S. PATENT DOCUMENTS

| | | | |
|---|---|---|---|
| 579,083 | 3/1897 | Searles | 30/317 X |
| 1,775,813 | 9/1930 | Colby | 30/317 |
| 2,346,474 | 4/1944 | De La Torre | 30/272 R |
| 2,639,505 | 5/1953 | Reynolds | 30/317 |
| 2,659,143 | 11/1953 | Baker | 30/317 |
| 3,906,561 | 9/1975 | Bawa | 30/317 X |

*Primary Examiner*—Stephen G. Kunin
*Assistant Examiner*—J. T. Zatarga
*Attorney, Agent, or Firm*—William E. Hein

[57] ABSTRACT

Shank and knife portions of a cutting tool having particular known utility in the leather tooling art are permitted to swivel within a sleeve member that is held in the chuck of a conventional electrical vibrating tool holder. An angular extension of the shank portion is bevelled to provide the knife portion of the cutting tool for contacting a leather work piece. The ease with which the shank and knife portions of the cutting tool are permitted to swivel is controlled at the time the cutting tool is inserted into the chuck of the tool holder by urging the sleeve against a spring that is coaxially positioned over the shank portion of the cutting tool between the sleeve member and a shoulder that serves to terminate the shank portion.

1 Claim, 3 Drawing Figures

LEATHER TOOLING APPARATUS

CROSS REFERENCE TO RELATED APPLICATION

This is a continuation of application Ser. No. 941,868, filed Sept. 13, 1978, now abandoned.

BACKGROUND AND SUMMARY OF THE INVENTION

This invention relates generally to cutting tools and more specifically to cutting tools that are employed in the leather tooling art. Conventional hand cutting tools that are generally employed by hobbyists and others engaged in the art of decorative leather tooling typically comprise knife-like blades fixedly and permanently mounted within a holder that is adapted for manual operation by the user. These tools are typically employed to effect a predetermined tooling design or pattern by moving the tool over the surface of the leather work piece in accordance with that design or pattern. As the tool is so moved, the operator applies varying degrees of pressure upon the leather work piece, thus cutting the leather work piece to varying depths. A significant drag, created by operation of the tool in this manner, reduces the degree of user control and oftentimes results in inadvertent and accidental cuts. In addition, such tools are difficult to use because of the fact that they must be constantly repositioned by the user in order to complete a typically intricate tooling pattern or design. Because of the intricacy of most designs it is generally necessary to frequently lift the cutting tool off the leather work piece to facilitate abrupt changes in direction of travel of the tool that are dictated by the particular design. Use of these prior art hand cutting tools requires a considerable degree of manual dexterity, thus rendering them nearly useless to those persons who have limited use of their arms and hands.

The present application teaches a swivelling cutting tool that substantially overcomes the disadvantages of those fixed tools constructed according to the prior art. In accordance with the illustrated preferred embodiment of the present invention, a cutting tool having a shank portion and a bevelled knife portion is adapted for use in an electrical vibrating tool holder, for example. A sleeve member is positioned over the shank portion of the cutting tool. A spring is positioned between the sleeve and the end of the shank portion of the tool. The sleeve and spring are restrained by means of a shoulder formed at the end of the shank portion. The tool is held in the vibrating tool holder by tightening the chuck of the vibrating tool holder over the sleeve member. The shank and knife portions of the tool are thus permitted to swivel within the sleeve member.

DESCRIPTION OF THE PREFERRED EMBODIMENT

Figure 1:
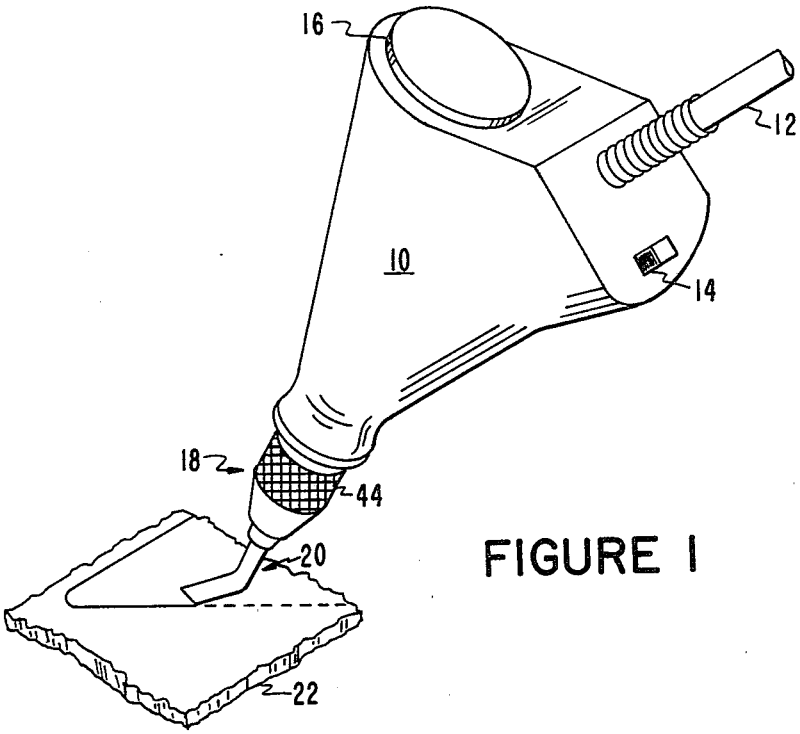
FIG. 1 is an illustration of how the cutting tool constructed according to the present invention is positioned within a vibrating tool holder for use on a leather work piece.

Referring now to FIG. 1, there is shown an electrical vibrating tool holder 10 that may comprise, for example, a Model V-73 Vibro-Graver manufactured by Burgess Vibrocrafters, Inc. Vibrating tool holder 10 is connected to a source of A.C. power via power cord 12. A power switch 14 controls the application of A.C. power, and a vibration control 16 is employed to adjust the intensity of vibration. A chuck assembly 18 holds a swivelling cutting tool 20 in position for performing desired tooling operations on a leather work piece 22. Chuck assembly 18 transmits a vibrating motion generated within vibrating tool holder 10 to the swivelling cutting tool 20.

Figure 2:
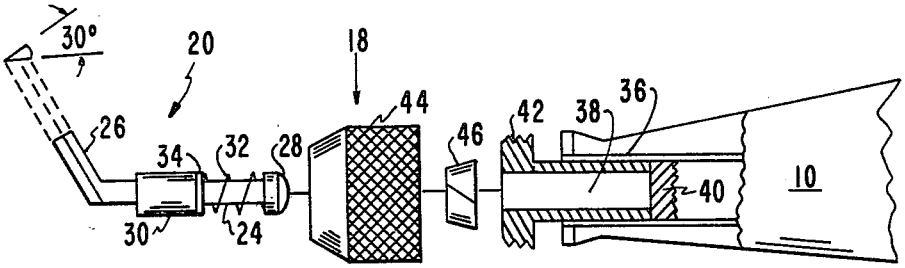
FIG. 2 is an exploded view of a portion of the vibrating tool holder and the cutting tool of FIG. 1 illustrating how the cutting tool is positioned in the chuck of the vibrating tool holder.

As shown in FIG. 2, swivelling cutting tool 20 comprises a shank portion 24 having a circular cross section and a bevelled knife portion 26 formed at an angle to shank portion 24. Shank portion 24 is terminated in a shoulder 28. A cylindrical sleeve 30 is positioned for free rotation and longitudinal translation over shank portion 24. A compressible spring 32 is coaxially positioned over shank portion 24 between sleeve 30 and shoulder 28. An optional washer 34 resides between sleeve 30 and one end of spring 32. As further illustrated in FIG. 2, chuck assembly 18 of vibrating tool holder 10 includes a rod-like vibrating member 36 formed to provide a protruding circular tool receptacle cavity 38. An internal end of tool receptacle cavity 38 is terminated to form a stop 40 against which shoulder 28 of swivelling cutting tool 20 is received. An external end of tool receptacle cavity 38 is open to receive the shank portion 24 of swivelling cutting tool 20. A protruding external end 42 of vibrating member 36 is threaded to receive a threaded collar 44. A split collet 46 resides within threaded collar 44 to securely clamp sleeve 30 when the cutting tool 20 is inserted into chuck assembly 18 of vibrating tool holder 10.

Prior to opertion, swivelling cutting tool 20 is inserted into chuck assembly 18 of vibrating tool holder 10 so that shoulder 28 is resident against stop 40. The ease with which cutting tool 20 is permitted to swivel is reduced by urging sleeve 30 against spring 32 and nearer shoulder 28 before tightening chuck assembly 18 over sleeve 30.

Figure 3:
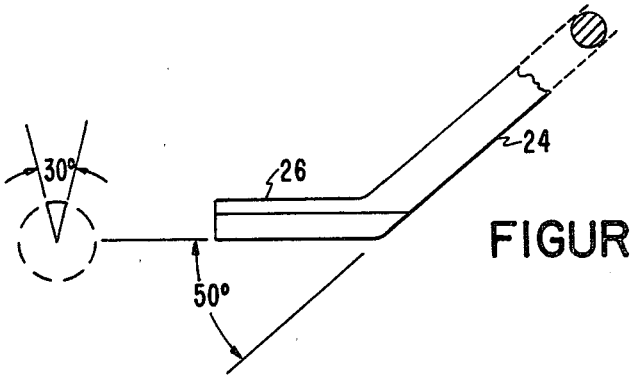
FIG. 3 is a diagram illustrating a preferred angular relationship between the shank and knife portions of the cutting tool of FIGS. 1 and 2 as well as a preferred cross section of the shank and knife portions of the cutting tool.

Referring to FIG. 3, there is shown a preferred angular relationship between the shank portion 24 and bevelled knife portion 26 of swivelling cutting tool 20. While this angular relationship may be varied to achieve optimum results in connection with different cutting operations, the illustrated angular relationship of approximately 50° has been found to provide entirely satisfactory results in the performance of most leather cutting operations. Similarly, the degree of bevel to which knife portion 26 is formed may vary to achieve certain desired results. However, the illustrated bevel angle of approximately 30° has been found to provide good results. The shank and knife portions of cutting tool 20 are preferably formed from a single length of hardened steel to provide the desired angular relationship therebetween, as illustrated in FIG. 3.

In operation, the user merely move vibrating tool holder 10 so as to guide the bevelled knife portion of swivelling cutting tool 20 over the leather work piece 22 in accordance with a desired pattern. Because of the swivelling characteristic of cutting tool 20, abrupt changes in the direction of a desired cut are easily effected as the result of nearly inperceptible changes in the position of the user's hand.

While the present invention has been described in connection with a preferred embodiment thereof, it will become apparent to those persons skilled in the art that various modifications and applications are possible. It is desired, therefore, that the invention not be limited to the details of construction illustrated and described hereinabove, and it is intended by the appended claims to cover all modifications which fall within the spirit and scope of the invention.

I claim:

1. A cutting tool comprising:

a shank portion terminated in a shoulder member;

an angularly extending knife portion;

a sleeve member positioned over said shank portion for rotational and translational movement with respect to said shank portion; and compressible spring means coaxially positioned with respect to said shank portion and retained between said sleeve member and said shoulder member.

* * * * *